US006986308B1

(12) United States Patent
King et al.

(10) Patent No.: US 6,986,308 B1
(45) Date of Patent: Jan. 17, 2006

(54) COMFORTABLE SERVING TRAY

(76) Inventors: Anthony John King, 1001, Ben Franklin Dr., #204, Sarasota, FL (US) 34236; Maureen Elizabeth King, 1001, Ben Franklin Dr., #204, Sarasota, FL (US) 34236

( * ) Notice: Subject to any disclaimer, the term of this patent is extended or adjusted under 35 U.S.C. 154(b) by 99 days.

(21) Appl. No.: 10/357,667

(22) Filed: Feb. 4, 2003

(51) Int. Cl.
*A47B 23/00* (2006.01)

(52) U.S. Cl. ..... 108/43; 108/25

(58) Field of Classification Search ..... 108/43, 108/44, 26, 25, 90; 248/444, 459
See application file for complete search history.

(56) References Cited

U.S. PATENT DOCUMENTS

| | | | | | |
|---|---|---|---|---|---|
| 2,669,495 | A | * | 2/1954 | Foote | 108/157.11 |
| 2,808,191 | A | * | 10/1957 | Cramer | 108/43 |
| 3,738,405 | A | * | 6/1973 | Ericson | 108/90 |
| 4,052,944 | A | | 10/1977 | Jennings | |
| 4,700,634 | A | * | 10/1987 | Mills et al. | 108/43 |
| 4,788,916 | A | | 12/1988 | Saxton | |
| 5,081,936 | A | * | 1/1992 | Drieling | 108/43 |
| 5,090,334 | A | * | 2/1992 | Sutton | 108/43 |
| 5,460,102 | A | * | 10/1995 | Pasmanick | 108/43 |
| 5,697,302 | A | * | 12/1997 | Putnam | 108/90 |
| 6,041,715 | A | * | 3/2000 | Jarke et al. | 108/43 |
| 6,050,200 | A | * | 4/2000 | Sullins et al. | 108/43 |
| 6,116,167 | A | * | 9/2000 | Rabe | 108/90 |
| 6,187,398 | B1 | * | 2/2001 | Eldridge | 108/43 |
| 6,374,751 | B1 | * | 4/2002 | With | 108/43 |

FOREIGN PATENT DOCUMENTS

GB 2140290 A * 11/1984

* cited by examiner

*Primary Examiner*—Jose V. Chen
(74) *Attorney, Agent, or Firm*—Dorothy S. Morse

(57) ABSTRACT

A food service and dining tray having a smooth upper surface, opposing end panels that provide sturdy handles, a perimeter rim with a minimum height dimension of approximately one inch extending between the end panels, a removable high-friction mat, and a yielding bottom portion filled with granular and/or soft material that conforms to the configuration of the surface or lap upon which it is placed. Optionally, the serving tray may have a detachable self-contained bottom portion, a perimeter groove for food crumbs and/or mat storage, and one or more recessed areas in its upper surface for maintaining a container holding an easily spilled food or beverage in a substantially upright and fixed position. Also, the mat may have thermal properties that protect the upper tray surface from damage during repeated use with hot food containers and/or help food containers to maintain elevated and chilled temperatures during transport.

20 Claims, 3 Drawing Sheets

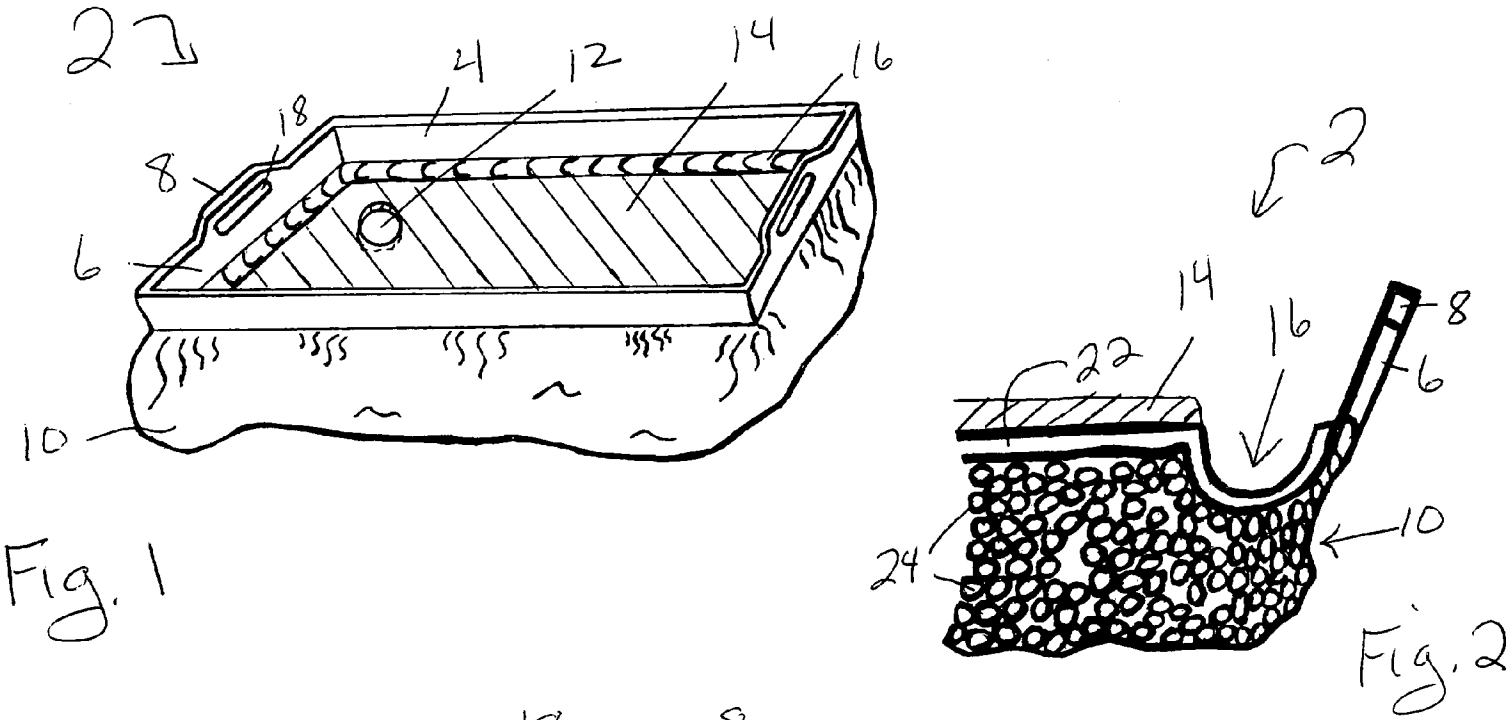
Fig. 2
Fig. 1
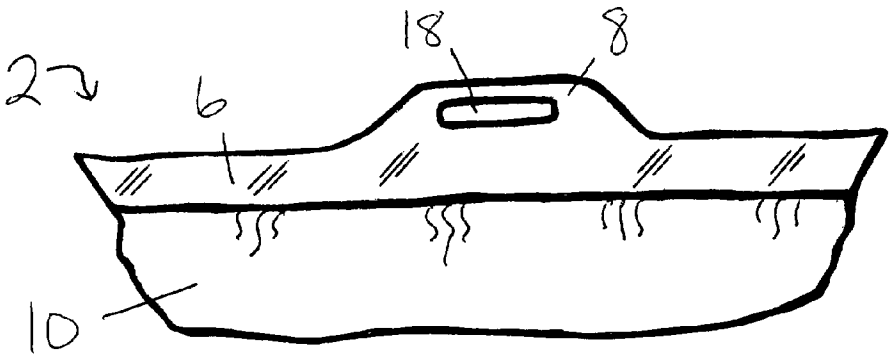
Fig. 3

COMFORTABLE SERVING TRAY

CROSS-REFERENCE TO RELATED APPLICATIONS

None

Background—Field of the Invention

The present invention relates to serving trays, and more particularly to a serving tray having an elongated configuration with a smooth upper surface, opposing end panels each having a sturdy handle means, a perimeter rim with a minimum height dimension of approximately one inch extending between the end panels and contiguous therewith, a removable high-friction mat capable of being rolled up into a compact cylindrical storage configuration when not needed for use, and a yielding bottom portion containing inert, non-toxic, non-allergenic, and lightweight soft fill material that conforms to the configuration of the surface or lap upon which it is placed. Optionally, the tray may also have a perimeter groove on one or more of its sides for food crumbs and/or placement of the high-friction mat when it is rolled into its compact storage configuration. Further options include a detachable self-contained bottom portion, and one or more recessed areas in the smooth upper surface for holding objects that contain easily spilled foods or beverages, such as but not limited to a glass, can, bottle, mug, or cup for a beverage or soup. Also, the mat may have thermal properties or a mesh configuration that protects the smooth upper tray surface from heat damage and/or helps to maintain elevated or reduced temperatures of pre-heated and pre-chilled food during its transport to the person intended to consume it.

Background—Description of Related Art

Trays are known for use in transporting food to the place where it will be served or eaten. One example is a bed tray with legs that collapse for storage, for serving food to invalids and others. However, when such trays are made from wood and have several containers filled with food or beverage supported on its upper surface, they can be heavy to transport. Further, during transport, supported containers often shift position on the upper surface of traditional serving trays, making spill-free transport awkward and difficult. In addition, when a tray with collapsible legs is presented to a person in bed, its height dimension is often too high or too low for the person using it, as well as too heavy to be supported directly upon the user's lap. Further, during eating use, food crumbs are nearly always created and spread over the food containers and tray surface, particularly when breads are a part of the meal served on the tray. Although not creating any hazard, the crumbs can be unsightly and detract from the dining experience. Another disadvantage of food served on a tray, is that it by the time it reaches the consumer, food that once was hot and very appealing has often cooled sufficiently to no longer present a strong appetite stimulus, something that can be important to a bedridden person or one that is recovering from an illness. In response to these deficiencies, the present invention provides a serving tray having a perimeter rim that helps to retain items on its surface during transport, as well as during use by those having weakened conditions and impaired sight, yet the rim is sufficiently low so as not to hinder use of the tray by the person dining from it. Further, the present invention serving tray has a sturdily constructed handle means that assists in confident and controlled tray transport. Ease in tray manipulation through sturdy and easily gripped handles reduces spillage during transport and assists in positioning the tray in an upright, or slightly tilted position if preferred, on the lap of its user. Further, use of a high-friction mat on the upper tray surface helps to prevent food containers from shifting position during transport, and while dining takes place by those having weakened physical states and diminished eyesight. The smooth upper tray surface facilitates adhesion of the high-friction mat. It is also contemplated for the mat to be removable for cleaning, or when the person using it prefers dining without it, such as to view a picture or other design on the upper tray surface, and although not critical it is preferred that the mat substantially cover the entire upper tray surface. When not in use, the high-friction mat should be able to be conveniently rolled up into a compact cylindrical storage configuration. For aesthetics, reduced cost, and/or practicality, a high-friction mat having a reduced size relative to the upper tray surface can be used as desired or needed. Further, the high-friction mat can optionally have thermal properties or a mesh configuration that help to protect the tray surface from heated tableware, protect it from spills involving high temperature foods, and/or assist in maintaining the original elevated or chilled temperature of some foods transported thereon. The tray and high-friction mat can also have one or more recesses or receptacles each configured to accommodate a glass, can, cup, mug, bottle, or other container for beverages, soup, and/or easily spilled foods. Corresponding recesses and receptacles that are to be combined for use in supporting a container for beverage or food would have a substantially similar size and be in substantially the same location relative to the upper tray surface. Optionally, instead of a receptacle, the high-friction mat can have a cutout through which a glass, can, cup, mug, bottle, or other container may be inserted into a recess. Further, the yielding bottom portion of the present invention is filled with an inert, non-toxic, non-allergenic, and lightweight soft fill material, that can be granular or filamentous, or a combination thereof, and which allows it to comfortably conform to the configuration of the surface or lap upon which it is placed. Optionally, the bottom portion can be self-contained and detachable through the use of quick-release fasteners, such as but not limited to a hook-and-pile type of fastener. The material or fabric from which the yielding bottom portion is made is preferably soft and washable. Should mechanical laundering be desired, it is contemplated that the fill material and/or insert containing fill material could be removed via a quick closure means, such as but not limited to a zipper that is in an out-of-the-way location and substantially hidden from view. Detachability permits exchange of one bottom portion for another and provides a bedridden person with new visual stimulus at a reduced cost. When not detachable, the bottom portion can be connected to the serving tray member by a variety of means, such as but not limited to decorative tacks, adhesive means, and/or bonding agent. The perimeter groove into which a person dining from the tray can temporarily sweep aside crumbs and other food residues created during the dining process, can enhance the user's dining experience by allowing that person to have control over the desired level of cleanliness and/or visible clutter on the upper tray surface. The: perimeter groove can also be used as a place in which to store the rolled-up high-friction mat when its use is not needed or desired.

The inventions thought to be the closest to the present invention are those disclosed in U.S. Pat. No. 4,052,944 to Jennings (1977) and U.S. Pat. No. 4,788,916 to Saxton (1988). However, there are important differences between the present invention and these other inventions. The Jennings invention discloses a portable desk with a hard desk surface, a partially rigid sub-cover that is coplanar with the hard desk surface, and a flexible casing means that is pillow-like and filled with dry, flowable material, such as sawdust, styrofoam beads or particles, and polyurethane beads or granules. After the edges of the casing are inturned over the sub-cover to form a container for the flowable fill material, the hard desk surface is cemented or otherwise adhered to the sub-cover. In contrast, the present invention has no sub-cover. The upper edges of its yielding bottom portion are either attached directly to the tray, or it has a detachable yielding bottom portion in the form of a self-contained sack with an upper surface that is directly attached to the bottom tray surface. In addition, while the Jennings invention comprises dry, flowable material, it is important for the present invention to be filled with inert, non-toxic, non-allergenic, and lightweight soft fill material that is either granular or filamentous, or a combination thereof, to include but not be limited to polystyrene beads, polyester, and fiberglass. The present invention must also have sturdy handles for confident transport of food and tableware, something not contemplated by the Jennings invention. Further, the present invention has a removable high-friction mat, capable of being rolled up into a compact cylindrical storage configuration, and the upper tray surface must be smooth for non-slip engagement with the high-friction mat. Also, although not critical, it is contemplated for the perimeter rim of the present invention to have a minimum height dimension of approximately one inch, as well as one or more optional recesses in the upper tray surface for enhanced retention and upright positioning of food containers that are either very full or have easily spilled contents. No perimeter rim of an inch or more, sturdy handle, or recess for a glass/mug/bottle/cup/can, is taught by the Jennings invention. Further, the present invention is also different from the Saxton invention, which is a take-apart pouch tray having a limp open-top pouch in detachable sealed relation with a peripheral depending sidewall. The Saxton invention further has a rigid planar top tray, and a replaceable limp closed bag in the pouch that is partially filled with lightweight flowable granules, with all components being washable. Different limp closed bags having distinguishable volumes of granules can be exchanged one for the other to vary pouch height. In contrast, the present invention has sturdy handle means, a removable high-friction mat that can have thermal properties, a smooth upper tray surface for non-slip engagement with the high-friction mat, and inert, non-toxic, non-allergenic, and lightweight soft fill material that can include filamentous and/or granular types of material. Since the yielding bottom portion of the present invention must conform to the lap or surface upon which it is placed, and provide cushioning to protect a user's lap from the weight of the tray, food, and tableware, it is contemplated for a substantial amount of fill material to be used within the yielding bottom portion of the present invention, and it would not be limp. Preferably, although not limited thereto, the height ratio of yielding bottom portion to tray is approximately 2:1, with a perimeter rim that typically has a minimum height dimension of approximately one inch. Illustrations of the Saxton invention show its limp closed bag to sidewall height ratio typically being at least 3:1 or 4:1. Also, when the present invention tray member is removable from its yielding bottom portion, its yielding bottom portion is manufactured as a self-contained sack and attachment of the tray member to the yielding bottom portion is achieved through the bottom surface of the tray member, not its sidewalls. Thus, neither the Jennings invention nor the Saxton invention, alone or in combination., teaches the present invention, and no other invention is known that has all of the features and advantages provided by the present invention.

BRIEF SUMMARY OF THE INVENTION—OBJECTIVES AND ADVANTAGES

The primary objective of this invention is to provide a serving tray that is lightweight and easy to use for transporting food and tableware to a diner without spills, and one that is also comfortable to a diner when placed upon his or her lap with the upper tray surface in a substantially horizontally-extending or slightly tilted position. It is a further objective of this invention to provide a serving tray that during routine transport and use assists containers placed upon its upper surface to remain in upright and fixed positions until needed for use. A further objective of this invention is to provide a serving tray with an aesthetically pleasing configuration and surface decorations that enhance the dining experience of its user. It is also an objective of this invention to provide a serving tray that has sturdy handle means for controlled/confident transport. A further objective of this invention is to provide a serving tray with a surface that during use can be readily swept clean of crumbs and other small pieces of food created during the dining process. It is also an objective of this invention to provide a serving tray and yielding bottom portion that are easily cleaned and otherwise maintained between uses.

The present invention helps its user to transport food items with confidence and in a controlled manner to its destination, since it has sturdily constructed handles, a perimeter rim configured to limit the extent of tableware and other object travel across the upper tray surface when unanticipated events cause some movement to occur, and high-friction means configured to help maintain tableware and food containers in their initial upright and fixed positions on its upper tray surface during transport. It is contemplated for the perimeter rim to be sufficiently high to properly fulfill its retaining function, but not so high as to hinder dining use. Preferably, the perimeter rim has a minimum height dimension of approximately one-inch or two-and-one-half centimeters. Comfort of the person dining from the present invention tray is enhanced by its ability to be positioned at different heights relative to the user. Although the easiest option is for the present invention tray to be placed directly upon the lap of its user with its yielding bottom portion conforming to the configuration of the user's lap while allowing the upper tray surface to remain in a substantially horizontally-extending or slightly tilted position, in the alternative the yielding bottom portion of the present invention serving tray can be easily positioned upon a blanket, pillow, or other object that is supported comfortably upon the user's lap, whereby it conforms to the configuration of that object while maintaining the upper tray surface in the desired horizontally-extending or slightly tilted position and further raising the upper tray surface to a height that is better adapted to the user's convenience, comfort, and/or need. Use of its removable high-friction mat also helps the present invention prevent food containers from shifting position during transport, as well as during dining by those having weakened physical states and/or diminished eyesight. Further, maintenance is reduced and aided by its design, whereby its high-friction mat protects the tray's upper surface from spills, the high-friction mat material reduces spills during transport and eating, the removable nature of its high-friction mat improves the speed and ease of cleaning the mat and upper tray surface, the perimeter groove into which crumbs and other food debris can be swept aside during use consolidates debris for easier cleanup between uses, and in detachable embodiments the detachable self-contained yielding bottom portion makes for less awkward cleaning of the upper tray surface, as well as easy laundering and/or exchange of one yielding bottom portion for another. The dining experience is improved through use of the present invention serving tray. Its mat can optionally have thermal properties to assist in maintaining the optimum temperature of food until it is consumed, hot or cold. Further, the upper tray surface is smooth, and it also can have decorative markings and/or a perimeter or other configuration that enhances its aesthetic appeal. The perimeter rim, sturdy handles, removable high-friction mat, and/or yielding bottom portion can also have any combination of decorative markings, surface texture, perimeter configuration, arcuate or curvilinear structure, or other configuration that enhances its aesthetic appeal. In embodiments having a detachable yielding bottom portion, one self-contained bottom portion can be exchanged for another with a different type of material, decorative markings, texture, and/or configuration, providing visual stimulus for those who are bedridden and pleasant variation for others. Also, use of the perimeter groove allows the dining person to have control over the desired level of cleanliness and clutter visible on the upper tray surface, and it facilitates clean up after dining since dry food crumbs swept into the perimeter groove remain dry and are more readily discarded than those that are left on the upper tray surface and become soggy as a result of contact with spilled liquids and other food residue.

While the description herein provides preferred embodiments of the present invention, it should not be used to limit its scope. For example, variations of the present invention, while not shown and described herein, can also be considered within the scope of the present invention, such as variations in the length and width dimensions of its upper tray surface, the number of sides incorporated into the perimeter of its upper tray surface, the height dimension of its perimeter rim, the number of recesses used in its upper tray surface, the type of inert and non-toxic fill material used within its yielding bottom portion, the configuration of its handles, and the size, number, and type of two-part quick-release fasteners used in detachable embodiments. Thus, the scope of the present invention should be determined by the appended claims and their legal equivalents, rather than being limited to the examples given.

BRIEF DESCRIPTION OF THE SEVERAL VIEWS OF THE DRAWINGS

FIG. 1 is a perspective view of the most preferred embodiment of the present invention having an upper surface covered by a high-friction mat, a perimeter rim, opposing end panels each having a sturdy handle, a perimeter groove, a yielding bottom portion, and one recess for a container used to hold an easily spilled food or beverage.

FIG. 2 is a sectional side view of the perimeter groove and the yielding bottom portion below it in the most preferred embodiment of the present invention, with the yielding bottom portion being substantially filled with granular fill material.

FIG. 3 is an end view of the first preferred embodiment of the present invention yielding bottom portion and tray end panel, with sturdy handle means incorporated into the tray end panel.

DETAILED DESCRIPTION OF THE INVENTION

Figure 5:
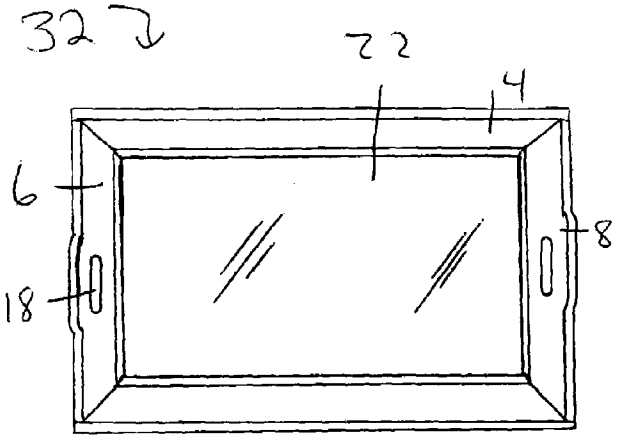
FIG. 5 is a top view of a third preferred embodiment of the present invention having a smooth upper tray surface, opposing end panels each having sturdy handle means, and a perimeter rim extending between opposing end panels and contiguous therewith.
Figure 4:
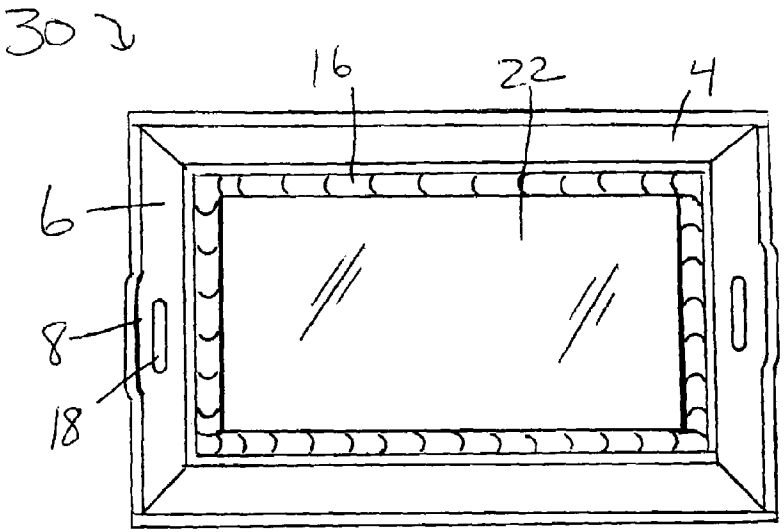
FIG. 4 is a top view of a second preferred embodiment of the present invention having a smooth upper tray surface, opposing end panels each having sturdy handle means, a perimeter rim, and a perimeter groove on all four sides of the upper tray surface.
Figure 6:
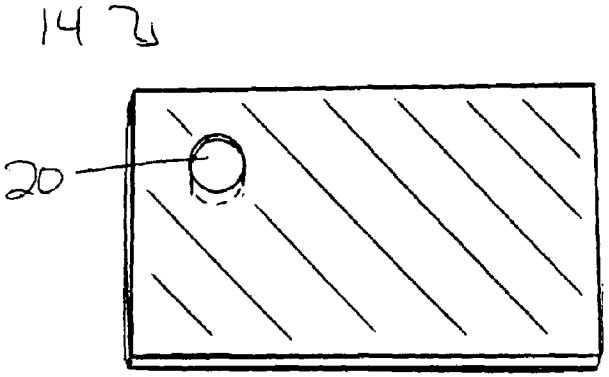
FIG. 6 is a perspective view of a first preferred embodiment of the present invention high-friction mat having a non-woven configuration and a receptacle for a container of liquids or other easily-spilled food, with the non-woven high-friction mat shown being usable with any embodiment of the present invention having an upper tray surface with a beverage container recess in the approximate position of the receptacle.

FIGS. 1, 2, and 3 show a first and most preferred embodiment 2 of the comfortable serving tray of the present: invention, although the perimeter groove 16 and the beverage container recess 12 shown as a part thereof are optional features. FIG. 1 shows first preferred embodiment 2 having a horizontally-extending high-friction mat 14 positioned directly upon and substantially covering a horizontally-extending smooth upper tray surface (similar to that shown in FIGS. 4 and 5 by the number 22), opposing end panels 6 each having a sturdy handle 8 with a horizontally-extending elongated aperture 18 therethrough, a perimeter rim 4 extending between opposing end panels and contiguous therewith, a perimeter groove 16 adjacent to one perimeter rim 4 and at least one end panel 6, a yielding bottom portion 10 downwardly extending below upper tray surface 22, and a recess 12 for a container (not shown) configured to hold an easily spilled food or beverage, such as but not limited to a glass, bottle, mug, cup, or can. Although FIG. 1 shows high-friction mat 14 to have a substantially rectangular configuration with end panels 6 being substantially planar, it is also considered to be within the scope of the present invention for end panels 6 to each have an angled and/or arcuate configuration as long as it provides a sturdy handle 8, and for high-friction mat 14 and upper tray surface 22 to have other elongated configurations, such as but not limited to that of an oval, elongated pentagon, elongated hexagon, elongated octagon, and the like. Also, although not shown, high-friction mat 14 may have a surface texture or decorative design, a combination of colors, one or more logos, and/or alpha-numeric markings. In contrast however, it is contemplated for upper tray surface 22 to be smooth so that a high level of non-slip adhesion is possible between it and high-friction mat 14. A high-friction mat 14 smaller than that illustrated in FIG. 1 is also contemplated. High-friction mat 14 should be promptly removable from upper tray surface 22 for easy cleaning and when a person prefers to dine directly from upper tray surface 22. FIG. 1 shows high-friction mat 14 having a hole therethrough (although the hole has been given no numeric designation) through which recess 12 in upper tray surface 22 can be seen. In the alternative, as shown in FIG. 6, it is also contemplated for the portion of high-friction mat 14 over recess 12 to have a complementary receptacle 20 conforming to the configuration of recess 12 that provides additional assistance in maintaining the beverage or food container positioned within recess 12 in a substantially upright position, and may also provide a selected amount of thermal insulation. The diameter and depth dimensions of recess 12 are not critical, although it is preferred for recess 12 to have a circular configuration suitable for containing the bottommost portion of the type of glass, bottle, or can commonly used to contain cold beverages, or the type of mug or cup used to contain a hot beverage, food, or soup (not shown). Should first preferred embodiment 2 be made with recess 12 having a diameter dimension sufficiently large to accommodate the largest cup, bottle, can, glass, or mug contemplated for routine use therewith and high-friction mat 14 with its receptacle 20 is not used, in the alternative although not shown, one or more removable inserts could be used as needed in recess 12 to stabilize smaller diameter cups, bottles, cans, glasses, and mugs during transport. FIG. 1 also shows perimeter groove 16 adjacent to one perimeter rim 4 and one end panel 6. Although perimeter groove 16 may extend around the entire perimeter edge of upper tray surface 22, as shown in FIG. 4, it is also contemplated for perimeter groove 16 to extend along only one perimeter rim 4 or one end panel 6, both perimeter rims 4, both end panels 6, or in the alternative to not be present at all, as shown in FIG. 5. The width dimension of perimeter groove 16 is not critical, but at a minimum should be sufficiently large to contain the crumbs of several very flaky or crumbly pieces of bread or pastries, such as a croissant. However, in most applications perimeter groove 16 does not have to be very wide or deep to perform its crumb-holding function. Another function contemplated for perimeter groove 16, although not shown, which might dictate a slightly larger width and/or depth dimension for perimeter groove 16, is to provide a place to temporarily store high-friction mat 14 when it is removed from upper tray surface 22 and set aside in a rolled/cylindrical storage configuration. FIG. 1 shows perimeter rim 4 having a small height dimension that would not interfere with the access of a person reaching for food or tableware (not shown) positioned on high-friction mat 14 or in recess 12.. Yet perimeter rim 4 needs to have a minimum height dimension of approximately one-inch or two-and-one-half centimeters, to be sufficiently tall to prevent food or tableware from traveling beyond perimeter groove 16 during routine transport. Further, although FIG. 1 shows yielding bottom portion 10 having a thickness dimension that is approximately twice the height of perimeter rim 4, and such proportion is preferred, the 2:1 height ratio of yielding bottom portion 10 to perimeter rim 4 is not critical. Instead, it is critical for yielding bottom portion 10 to have sufficient fill material and a sufficiently thick height dimension for comfortable support of the weight of upper tray surface 22 and tableware (not shown), as well as food items supported thereon (not shown) upon the lap of a diner. Thus, as shown in FIG. 2 and to provide the necessary level of comfort, it is contemplated for yielding bottom portion 10 in first preferred embodiment 2 to be substantially filled with granular material 24 so that it can conform to the surface configuration of the lap or other surface upon which it is placed, and it would not be limp. Filamentous soft fill material, although not shown, to also be used within yielding bottom portion 10, alone or in combination with granular material 24. Therefore, it is considered to be within the scope of the present invention for soft fill material can be any filamentous or other material that provides support for perimeter rim 4, end panels 6, and upper tray surface 22 while at the same time being comfortable to the user (not shown) when placed directly on his or her lap. Yielding bottom portion 10 should provide a substantially horizontally-extending orientation for high-friction mat 14 and upper tray surface 22 for dining use, however, since some tilting of upper tray surface 22 toward a user may provide an advantage in selected applications, a slightly tilted orientation of upper tray surface 22 is also considered to be within the scope of the present invention. Although not critical, it is also contemplated for the fabric or other material used in the most preferred embodiment of the present invention for the creation of yielding bottom portion 10 to be washable, flexible, and soft. Loosely woven fabrics and those having a rough surface texture would typically be avoided. In addition, the material used for yielding bottom portion 10 can be devoid of surface decoration, as shown in FIG. 1, or alternatively, although not shown, have any surface texture or decorative design, one or more logos, any color or color combination, and/or one or more alpha numeric markings. The means of attaching yielding bottom portion 10 beneath upper tray surface 22 is not critical, and can be accomplished by any means providing a secure connection therebetween, such as but not limited to adhesive means, bonding agent, decorative tacks, or a combination thereof or other attachment means. Further, the configuration and size of handles 8 and elongated aperture 18 shown in FIG. 1 are not critical, and handles 8 or apertures 18 may be of any perimeter configuration, angular or arcuate or combination, that provides a sturdy grip for the hands of its user. Handles 8 may also have a greater height dimension than is shown in FIG. 1, but should not be so large as to provide additional weight to first preferred embodiment 2 without affording significant structural or aesthetic benefit.

FIGS. 2 and 3 also show first embodiment 2 having a yielding bottom portion 10 with a height dimension that is approximately twice that of end panel 6. Although FIG. 2 shows yielding bottom portion 10 being somewhat loosely filled with granular material 24, it is not meant to be limp, but to be substantially filled with soft fill material to provide comfortable support of upper tray surface 22, perimeter rims 4, end panels, 6, and tableware thereon when yielding bottom portion 10 is placed upon the lap of its user. In the alternative, although not shown, it is also contemplated for the yielding bottom portion 10 of first preferred embodiment 2 to contain soft filamentous fill material, alone or in combination with granular material 24. In addition, FIG. 2 shows high-friction mat 14 positioned upon upper tray surface 22, a perimeter groove 16 adjacent to end panel 6, and a sturdy handle 8 rising above end panel 6. FIG. 3 shows end panel 6 having; sturdy handle 8 upwardly depending therefrom and centered thereabove, with one elongated and horizontally-extending aperture 18 through sturdy handle 8. FIG. 3 further shows aperture 18 being centered both horizontally and vertically through sturdy handle 8. While not critical, approximate centering of aperture 18 within sturdy handle 8, as well as centering of sturdy handle 8 within end panel 6, facilitates comfortable and balanced transport of first preferred embodiment 2 and is preferred. It is contemplated that aperture 18 could be smaller or larger than what is shown in FIG. 3, and although not shown and not preferred, it is considered to be within the scope of the present invention for sturdy handles 8 to each have a sequence of two or more smaller apertures 18 that are each configured and/or positioned in sequence for comfortable insertion of one or more the fingers of a person needing to transport it. As can be seen from the combination of FIGS. 1, 2, and 3, end panels 6 and perimeter rim 4 are vertically extending, however, neither has to be in exact vertical orientation. In fact the slightly outward non-vertical orientation shown in FIGS. 1–3 is preferred as it provides a user with a little more room for lateral and forward movement in reaching food and tableware items positioned on high-friction mat 14.

FIGS. 4 and 5 respectively show a second preferred embodiment 30 and a third preferred embodiment 32 of the present invention comfort serving tray. FIG. 5 shows second preferred embodiment 30 having a smooth and substantially horizontally-extending upper tray surface 22, opposing end panels 6 each having a sturdy handle 8, a perimeter rim 4 extending between opposing end panels 6, an elongated aperture 18 centered through each sturdy handle 8, and a perimeter groove 16 on all four sides of upper tray surface 22. In contrast, FIG. 5 shows third preferred embodiment 32 having a smooth and substantially horizontally-extending upper tray surface 22, opposing end panels 6 each having a sturdy handle 8, a perimeter rim 4 extending between opposing end panels 6, and an elongated aperture 18 centered through each sturdy handle 8. Although a high-friction mat 14 is not shown in FIGS. 4 and 5 upon upper tray surface 22, it is contemplated that a high-friction mat 14 could be used with second preferred embodiment 30, as well as third preferred embodiment 32. For effective use of high-friction mat 14, it is contemplated for upper tray surface 22 to be smooth, and perhaps also shiny, to provide the necessary amount of adhesion between it and high-friction mat 14 to maintain tableware and food in substantially fixed positions thereon during transport. FIGS. 4 and 5 further show perimeter rim 4 and end panels 6 vertically extending, however, not in exact vertical orientation, whereby each angles outwardly away from its opponent. While such an outwardly angled configuration is preferred, it is not critical.

Figure 7:
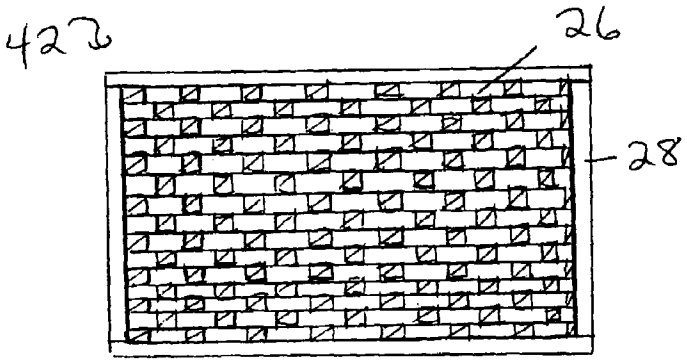
FIG. 7 is a top view of a second preferred embodiment of the present invention high-friction mat having a woven center portion and a distinguishable perimeter portion, with the woven high-friction mat shown being usable with any embodiment of the present invention lacking a beverage container recess.

FIG. 6 shows the high-friction mat 14 of FIG. 1 having a substantially planar non-woven configuration and a receptacle 20 into which the bottommost portion of a container of liquids or easily spilled food can be positioned. When receptacle 20 is used, it assists in the secure positioning of a bottle, can, glass, cup, or mug within recess 12 during present invention transport. In the alternative, although not shown, in place of receptacle 20 it is contemplated for high-friction mat 14 to have a hole therethrough configured for insertion of a bottle, glass, cup, can, mug, or other container intended for direct placement into a correspondingly positioned recess 12 within upper tray surface 22. FIG. 7 shows an alternative mat structure 42 with a center woven portion 26 and a distinguishable perimeter portion 28. The woven/mesh configuration of center woven portion 26 can provide a heat protecting function for upper tray surface 22. Although not limited thereto, center woven portion 26 could have more pronounced thermal characteristics as compared to distinguishable perimeter portion 28, and distinguishable perimeter portion 28 could have enhanced non-slip gripping capability relative to center woven portion 26. Although not shown, it is also contemplated for the scope of the present invention to include other mat configurations with differing combinations of woven and non-woven materials, for aesthetic as well as functional purposes, to include but not be limited to distinguishable perimeter portions 28 having width dimensions different from that shown in FIG. 7, such as a non-woven mat with a distinctive perimeter portion 28 or an alternative mat structure 42 only with center woven portion 26, a mat with a left (or right) half that is woven and the other half being non-woven, and a woven mat with no distinctive perimeter portion 28. The critical element of mat configuration is its high-friction composition, surface texture, or combination thereof, which prevents items placed thereon from slipping or sliding across its exposed surface, and not its size, surface decoration, thickness dimension, color, perimeter configuration (which does not have to be limited to the rectangular configuration shown in FIGS. 6 and 7), or flexibility although high-friction mat 14 and alternative mat structure 42 should be able to be rolled up into a cylindrical configuration for compact storage when its use is not needed or desired.

Figure 8:
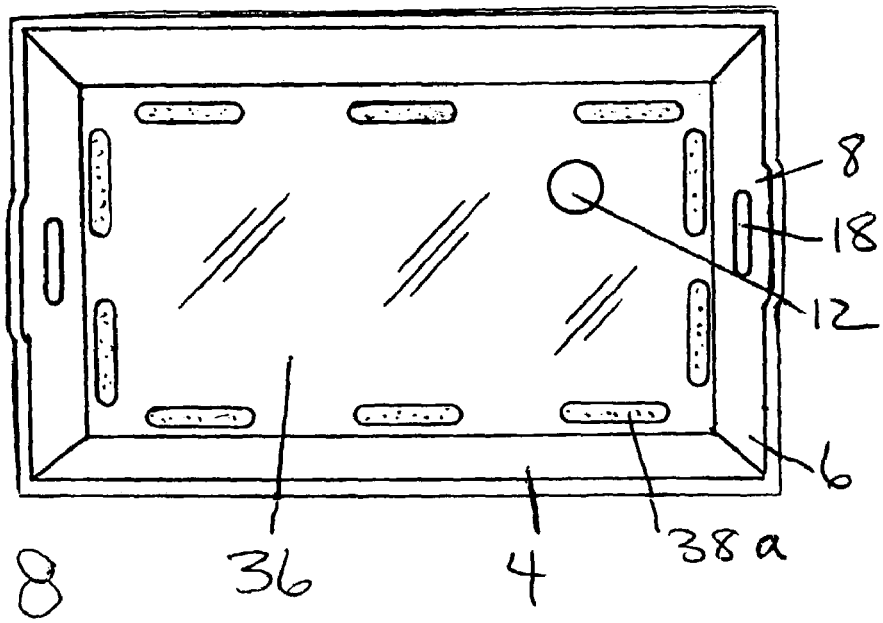
FIG. 8 is a bottom view of the most preferred embodiment of the present invention tray usable in the fourth preferred embodiment shown in FIG. 9 and having a first part of several two-part quick-release fasteners on its bottom surface for attachment to complementary second quick-release fastener parts located on the top surface of a self-contained yielding bottom portion.
Figure 9:
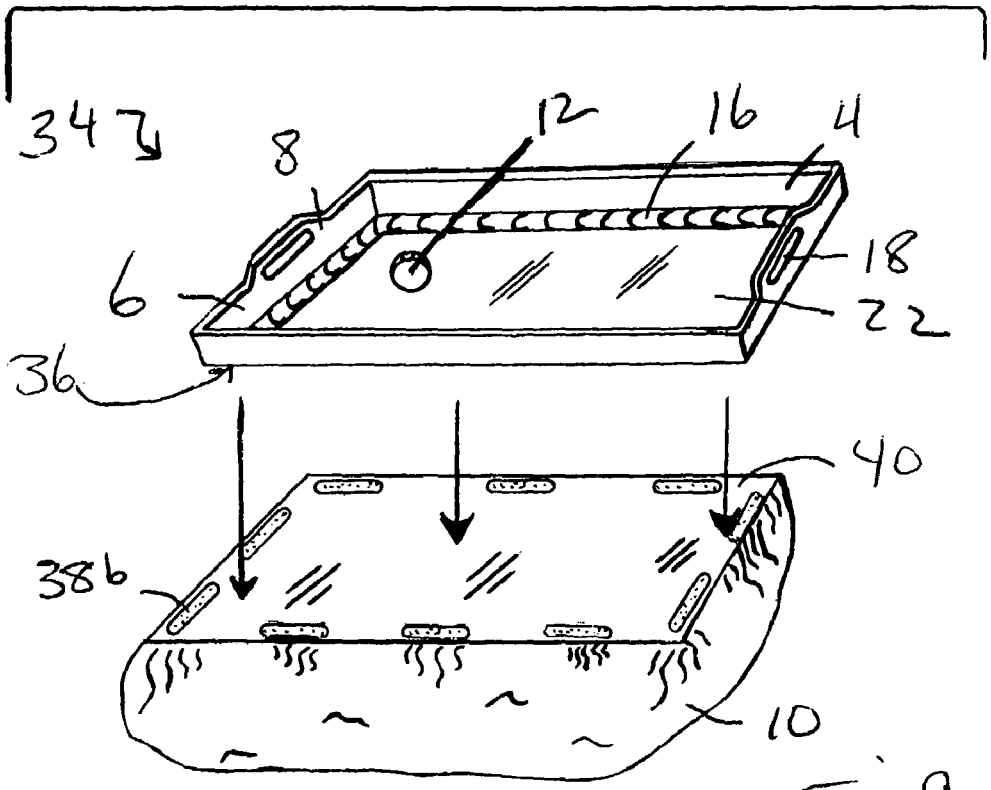
FIG. 9 is a perspective view of a fourth preferred embodiment of the present invention having a serving tray with a detachable self-contained yielding bottom portion ready for connection thereto with two-part quick-release fasteners.

FIGS. 8 and 9 illustrate a fourth preferred embodiment of the present invention 34 having a self-contained yielding bottom portion 10 detachably connected via multiple two-part quick-release fasteners 38*a* and 38*b* to bottom tray surface 36. FIG. 9 shows fourth preferred embodiment 34 having a detachable yielding bottom portion 10 with a self-contained and sealed configuration, while FIG. 8 shows the corresponding bottom tray surface 36 to which the top surface 40 of self-contained yielding bottom portion 10 would be securely attached with quick-release fasteners 38*a* and 38*b*. It is intended for the upper tray surface 22 in fourth preferred embodiment 34 to be smooth, and perhaps shiny, for good adhesion of high-friction mat 14 thereto. Although it is preferred for soft filamentous fill material (not shown), granular material 24, and/or a combination thereof to substantially fill yielding bottom portion 10, yielding bottom portion 10 must not be too firm so that it will be able to conform to the lap of a user or other surface upon which it is placed. The number and size of quick-release fasteners 38*a* and 38*b* used are not critical, as long as they provide secure attachment between the bottom tray surface 36 and the top surface 40 of yielding bottom portion 10. Ease of connection and release, as well as cost benefit, are also considerations used in selecting the type of fasteners used for 38*a* and 38*b*. Thus, a number of fasteners 38*a* and 38*b* larger than that shown in FIGS. 8 and 9 could be used in fourth preferred embodiment 34, as well as fasteners 38*a* and 38*b* that are smaller that those shown in FIGS. 8 and 9. It is even considered within the scope of the present invention, although not necessarily preferred when cost is a factor, for one elongated fastener 38*a* and one elongated fastener 38*b* to be used where appropriate for the intended application, with fasteners 38*a* and 38*b* each extending the full perimeter of top surface 40 and bottom tray surface 36. Also, although the fasteners 38*a* and 38*b* used in FIGS. 8 and 9 appear as hook-and-pile fasteners, and hook-and-pile fasteners are preferred, the use of other types of quick-release fasteners for 38*a* and 38*b* is also contemplated. Further, when hook-and-pile fasteners 38*a* and 38*b* are used, it is preferred for the pile portion to be attached to bottom tray surface 36 and the corresponding hook portion attached to yielding bottom portion 10 for enhanced user comfort should bottom tray surface 36 ever be used apart from yielding bottom portion 10 for any purpose. FIG. 9 further shows a recess 12 in upper tray surface 22, a perimeter groove 16, a sturdy handle 8 on each end panel 6, a perimeter rim extending between end panels 6, an elongated aperture 18 through each sturdy handle 8, and an arrow pointing to bottom tray surface 36, while FIG. 8 shows recess 12 extending beyond bottom surface 36, a sturdy handle 8 on each end panel 6, perimeter rim 4 extending between end panels 6, and an elongated aperture 18 through each sturdy handle 8. In contrast, although not shown, aperture 18 could have a configuration different from that shown in FIGS. 8 and 9, such as but not limited to a more rounded or angular configuration. Further, although not shown and where appropriate to the application, for ease of laundering the self-contained yielding bottom portion 10 shown in FIG. 9, a substantially hidden zipper or two-part quick-release fastener such as 38*a* and 38*b*, or a sealable slit or overlapping configuration within top surface 40, could be used that would allow intact filamentous soft fill material within yielding bottom portion 10 to be readily removed as a unit and then subsequently replaced when laundering is complete. However, for simple spot cleaning of small sections of yielding bottom portion 10, removal of the soft fill material therein is not contemplated. Upper tray surface 22 can be devoid of surface markings, as shown in FIG. 9, or be decorated with surface pictures or other designs (not shown). Upper tray surface 22 is preferably made from wood or plastic materials, although not limited thereto. The most important considerations for the material used for upper tray surface 22 are its weight, as the present invention should he sufficiently lightweight for confident and controlled transport by a user, and the ability of the material to form a smooth, and perhaps also shiny, upper tray surface 22 for secure adhesion thereto of high-friction mat 14 or alternative mat structure 42. High-friction mat 14 and alternative mat structure 42 can be made from any rubberized or plastic material having high-friction characteristics, or in the alternative its non-slip character can be largely attributable to its surface texture and/or design, or both. Since they are to be used with food, it is important that high-friction mat 14 and alternative mat structure 42, as well as all other materials used for the present invention, to be non-toxic and readily washable. In addition, the materials used for high-friction mat 14 and alternative mat structure 42 can have thermal characteristics that protect upper tray surface: 22 from damage what high temperature food containers are repeated placed thereon. Also, the thermal characteristics of high-friction mat 14 and alternative mat structure 42 can assist in maintaining elevated and reduced temperatures in served food during transport to provide more appetite-stimulating consumption for the person intending to cat it. Further, the fabrics used for yielding bottom portion 10 can vary in quality and design, but it is preferred that they not be too loosely woven for inadvertent loss of soft fill material, or abrasive to the touch. Although not limited thereto, the soft fill material used within yielding bottom portion 10 can be made from fiberglass or polyester, or inert or other non-allergenic material, and granular fill material 24 can include polystyrene beads exclusively, or in part.

What is claimed is:

1. A food service and dining tray for use in providing appetite stimulus to the person receiving food on it, particularly bedridden, weakened, and impaired people, through visual and physical enhancement of the food and its presentation, said food service and dining tray comprising, a smooth and substantially planar upper tray surface configured for promoting secure adhesion of high-friction-material;

opposing end panels upwardly depending from said upper tray surface, with each said end panel having sturdy handle means adapted for controlled transport of said upper tray surface in a substantially horizontally-extending orientation when it supports food items and tableware so as to maintain food items and tableware in their originally established positions relative to said upper tray surface subsequent to transport;

two opposing perimeter rims upwardly depending from said upper tray surface, with each of said rims having a first end contiguous with one of said opposing end panels and a second end contiguous with the other of said opposing end panels, said perimeter rims having a height dimension less than that of said opposing end panels;

a substantially planar high-friction mat having a maximum surface area no larger than that of said upper tray surface, said mat being capable of maintaining tableware items in their originally established positions during dining and transport, said mat also being sufficiently flexible for rolling into a compact storage configuration; and a yielding bottom portion substantially filled with inert, non-toxic, non-allergenic, and lightweight soft fill material configured and positioned so that said yielding bottom portion is able to conform to the configuration of the surfaces and laps upon which it is placed, and also comfortably support the combined weight of said upper tray surface, said opposing end panels, said perimeter rims, and said high-friction mat, as well as any supported tableware, when said food service and dining tray is placed upon the lap of the person dining from it.

2. The food service and dining tray of claim 1 wherein said upper surface further comprises at least one recess configured for holding the bottommost portion of a container configured for beverages and easily spilled foods.

3. The food service and dining tray of claim 1 wherein said soft fill material is selected from a group consisting of granular material, filamentous material, polystyrene beads, fiberglass, and polyester.

4. The food service and dining tray of claim 1 wherein said upper tray surface has a perimeter edge and further comprising a perimeter groove positioned adjacent to said perimeter edge, and wherein said perimeter groove has a dimension adequate for retaining said high-friction mat when it is rolled into said compact storage configuration.

5. The food service and dining tray of claim 4 wherein said perimeter groove is selected from a group consisting of a perimeter groove located adjacent to one of said end panels, a perimeter groove located adjacent to both of said end panels, a perimeter groove located adjacent to one of said perimeter rims, a perimeter groove located adjacent to both said perimeter rims, a perimeter groove located adjacent to one of said end panels and both said perimeter rims, a perimeter groove located adjacent to one of said perimeter rims and both of said end panels, and a perimeter groove located adjacent to both said perimeter rims and both of said end panels.

6. The food service and dining tray of claim 1 further comprising a substantially planar bottom tray surface in an opposing position to said upper tray surface and wherein said yielding bottom portion is self-contained with a top surface, and further comprising a plurality of reusable two-part quick-release fasteners, with one part of each said two-part quick-release fastener being permanently attached to said bottom tray surface and the second part of each said two-part quick-release fastener being permanently attached to said top surface of said yielding bottom portion in opposing positions so that when opposing ones of said first and second parts are connected to one another, said two-part quick-release fasteners allow secure connection between said top surface and said bottom tray surface for prompt substitution of replacement yielding bottom portions having sufficiently different surface decoration to provide visual enhancement of food presentation during successive meals eaten from said food service and dining tray.

7. The food service and dining tray of claim 1 wherein said high-friction mat is made from material having thermal properties that permit it to protect said upper tray surface from heat damage and also help to maintain elevated and reduced temperatures in tableware, foods, and beverages situated thereupon and thereabove during transport.

8. A food service and dining tray for use in providing appetite stimulus to the person receiving food on it, particularly bedridden, weakened, and impaired people, through visual and physical enhancement of the food and its presentation, said food service and dining tray comprising, a smooth, elongated, and substantially planar upper tray surface having a perimeter edge and being configured for promoting secure adhesion of high-friction material;

opposing end panels upwardly depending from said upper tray surface, with each said end panel having sturdy handle means adapted for controlled transport of said upper tray surface in a substantially horizontally-extending orientation when it supports food items and tableware so as to maintain food items and tableware in their originally established positions relative to said upper tray surface subsequent to transport;

two opposing perimeter rims upwardly depending from said upper tray surface, with each of said rims having a first end contiguous with one of said opposing end panels and a second end contiguous with the other of said opposing end panels, said perimeter rims having a height dimension less than that of said opposing end panels;

a substantially planar high-friction mat having a maximum surface area no larger than that of said upper tray surface, said mat being capable of maintaining tableware items in their originally established positions during dining and transport, said mat also being sufficiently flexible for rolling into a compact storage configuration, and further wherein said high-friction mat is made from material having thermal properties that permit it to protect said upper tray surface from heat damage and also help to maintain elevated and reduced temperatures in tableware, foods, and beverages situated thereupon and thereabove during transport;

a groove positioned adjacent to said perimeter edge of said upper tray surface, said groove also having a dimension adequate for retaining said high-friction mat when it is rolled into said compact storage configuration; and a yielding bottom portion substantially filled with lightweight, inert, non-toxic, and non-allergenic soft fill material configured so that said yielding bottom portion is able to conform to the configuration of the surfaces and laps upon which it is placed, and also comfortably support the combined weight of said upper tray surface, said opposing end panels, said perimeter rims, and said high-friction mat, as well as any supported tableware, when said food service and dining tray is placed upon the lap of the person dining from it.

9. The food service and dining tray of claim 8 wherein said upper surface further comprises at, least one recess configured for holding the bottommost portion of a container configured for beverages and easily spilled foods.

10. The food service and dining tray of claim 9 wherein said high friction mat configuration that is complementary to said at least one recess.

11. The food service and dining tray of claim 9 wherein said high-friction mat has at least one cutout area complementary in size and location to said at least one recess and through which the bottommost portion of a container can be inserted for positioning within said at least one recess.

12. The food service and dining tray of claim 8 wherein each of said end panels has a non-vertical orientation that is outwardly angled away from the other.

13. The food service and dining tray of claim 8 wherein said yielding bottom portion has a height dimension, and said height dimension of said yielding bottom portion is approximately twice said height dimension of said perimeter rims.

14. The food service and dining tray of claim 8 further comprising a substantially planar bottom tray surface in an opposing position to said upper tray surface and wherein said yielding bottom portion is self-contained with a top surface, and further comprising a plurality of reusable two-part quick-release fasteners, with one part of each said two-part quick-release fastener being permanently attached to said bottom tray surface and the second part of each said two-part quick-release fastener being permanently attached to said top surface of said yielding bottom portion in opposing positions so that when opposing ones of said first and second parts are connected to one another, said two-part quick-release fasteners allow secure connection between said top surface and said bottom tray surface for prompt substitution of replacement yielding bottom portions having sufficiently different surface decoration to provide visual enhancement of food presentation during successive meals eaten from said food service and dining tray.

15. A method for manufacturing a food service and dining tray usable for appetite stimulus to the person receiving food on it, particularly bedridden weakened and impaired people through visual and physical enhancement of the food and its presentation, said method comprising the steps of:

providing a substantially planar and smooth upper tray surface configured for promoting secure adhesion of high-friction material and that also has an opposing bottom tray surface, two opposing end panels each having sturdy handle means, two pieces of perimeter rim material each having a height dimension less than that of said end panels, a substantially planar and high-friction mat having a surface area no larger than said upper tray surface and being capable of maintaining tableware items placed thereon in their originally established positions during dining and transport in addition to the capability for being rolled into a compact storage configuration, and a yielding bottom portion containing lightweight, inert, non-toxic, and non-allergenic soft fill material that is configured to conform to the configuration of the surfaces and laps upon which it is placed and also comfortably supports the combined weight of said upper tray surface, said opposing end panels, said perimeter rims, and said high-friction mat when all are placed upon the lap of a person;

attaching said opposing end panels to said upper surface in an upwardly depending fashion;

extending said two pieces of perimeter rim material so that they upwardly depend from said upper tray surface between said opposing end panels and contiguous therewith;

attaching said yielding bottom portion to said bottom tray surface; and removably positioning said mat on said upper tray surface when it is needed during transport of containers holding hot and cold foods for reduced spills and damage to said upper tray surface, as well as during dining for the same two purposes and also to firmly secure tableware in fixed positions relative to said upper tray surface.

16. The method of claim 15 further comprising the step of forming at least one recess in said upper tray surface that is configured to hold the bottommost portion of a container configured for beverages and easily spilled foods.

17. The method of claim 15 wherein said lightweight and soft fill material is selected from a group consisting of granular material, filamentous material, polystyrene beads, fiberglass, inert material, non-toxic material, non-allergenic material, and polyester.

18. The method of claim 15 wherein said upper tray surface has a perimeter edge, and further comprising the step of forming a perimeter groove adjacent to said perimeter edge.

19. The method of claim 15 further comprising the steps of providing a plurality of reusable two-part quick-release fasteners having a first fastening part and a second fastening part, a plurality of yielding bottom portions having visually different surface decoration, and additional second fastening parts, and wherein said step of attaching one of said yielding bottom portions at a time to said bottom tray surface further comprises a step of attaching a first fastening part of each said two-part quick-release fastener to said bottom tray surface, a step of attaching second fastening parts to said top surface of each of said yielding bottom portions in a location that allows secure attachment between said first and second fastening parts when said bottom tray surface is placed in contact with a selected one of said top surfaces, and a step of placing said bottom tray surface in contact with said selected top surface to securely connect said first and second fastening parts to one another for prompt replacement of one of said yielding bottom portions for anther to provide visual enhancement of food presentation during successive meals eaten from said food service and dining tray.

20. The method of claim 15 wherein said high-friction mat is made from material having thermal properties that permit it to protect said upper surface from heat damage and also help to maintain elevated and reduced temperatures in tableware, foods, and beverages situated thereupon and thereabove during transport.

* * * * *